United States Patent [19]

Wiehler

[11] Patent Number: 4,564,788

[45] Date of Patent: Jan. 14, 1986

[54] DELAY LINE FOR HIGH-PERFORMANCE TRAVELING-WAVE TUBES, IN THE FORM OF A TWO PART-TUNGSTEN AND MOLYBDENUM-RING RIBBON CONDUCTOR

[75] Inventor: Wolf Wiehler, Neubiberg, Fed. Rep. of Germany

[73] Assignee: Siemens Aktiengesellschaft, Berlin and Munich, Fed. Rep. of Germany

[21] Appl. No.: 518,143

[22] Filed: Jul. 28, 1983

[30] Foreign Application Priority Data

Jul. 30, 1982 [DE] Fed. Rep. of Germany ..... 3228529

[51] Int. Cl.[4] ..... H01J 25/34

[52] U.S. Cl. ..... 315/3.6; 315/3.5; 315/39.3

[58] Field of Search ..... 315/3.5, 3.6, 39.3; 313/311; 333/162, 163

[56] References Cited

U.S. PATENT DOCUMENTS

| | | | |
|---|---|---|---|
| 3,349,278 | 10/1967 | Huse | 315/3.6 |
| 3,735,188 | 5/1973 | Anderson | 315/3.6 |
| 4,093,892 | 6/1978 | Vanderplaats | 315/39.3 |
| 4,185,225 | 1/1980 | Boehler | 315/3.6 |
| 4,229,676 | 10/1980 | Manoly | 315/3.6 |
| 4,270,069 | 5/1981 | Wiehler | 315/3.6 |
| 4,465,987 | 8/1984 | Monoly | 315/3.5 |

FOREIGN PATENT DOCUMENTS

| | | | |
|---|---|---|---|
| 2834135 | 7/1982 | Fed. Rep. of Germany . | |
| 0064737 | 4/1983 | Japan | 315/3.6 |

*Primary Examiner*—Jerome Massie

*Attorney, Agent, or Firm*—Herbert L. Lerner; Laurence A. Greenberg

[57] ABSTRACT

A delay line assembly for high-performance traveling-wave tubes having an electron beam generating system and an electron beam collector, includes a copper vacuum enclosure, a delay line in the form of a ring ribbon conductor disposed in the vacuum enclosure between the electron beam generating system and the electron beam collector, and a plurality of dielectric mounting rods extended parallel to the ring ribbon conductor in the vacuum enclosure for supporting the delay line, the ring ribbon conductor being formed of a relatively more highly thermally stressed tungsten part and a relatively less highly thermally stressed molybdenum part.

6 Claims, 2 Drawing Figures

Figure 2:
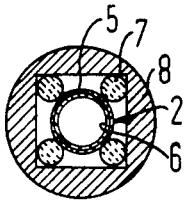

DELAY LINE FOR HIGH-PERFORMANCE TRAVELING-WAVE TUBES, IN THE FORM OF A TWO PART-TUNGSTEN AND MOLYBDENUM-RING RIBBON CONDUCTOR

The invention relates to a delay line for high-performance traveling-wave tubes in the form of a ring ribbon conductor disposed between an electron beam generating system and an electron beam collector with a sturdy copper vacuum enclosure, and a plurality of dielectric mounting rods parallel to the delay line for supporting the delay line. Such a delay line is known from German Published, Prosecuted Application No. DE-AS 28 34 135, corresponding to U.S. Pat. No. 4,270,069.

One of the main requirements which a ring ribbon conductor for high-performance traveling-wave tubes must meet, is the best possible heat removal. The best solution with respect to this requirement would be the use of a ring ribbon conductor formed of copper. However, since copper is a very soft material, problems arise regarding the dimensional stability in the manufacture, measurement, storage and soldering-in of such a conductor. The conductor would have to be soldered along the entire length thereof to the dielectric mounting rods which are usually formed of beryllium oxide, using an internal soldering arbor which must later be removed. To this disadvantage is added the aggravating factor of the large thermal expansion of copper which manifests itself particularly greatly in the axial direction.

It is accordingly an object of the invention to provide a delay line for high-performance traveling-wave tubes, in the form of a ring ribbon conductor, which overcomes the hereinafore-mentioned disadvantages of the heretofore-known devices of this general type and to optimize the heat removal and the stability of a ring ribbon conductor, especially in the thermally heavily stressed part of the conductor.

With the foregoing and other objects in view there is provided, in accordance with the invention, a delay line assembly for high-performance traveling-wave tubes having an electron beam generating system and an electron beam collector, comprising a solid or sturdy copper vacuum enclosure, a delay line in the form of a ring ribbon conductor disposed in the vacuum enclosure between the electron beam generating system and the electron beam collector, and a plurality of dielectric mounting rods extended parallel to the ring ribbon conductor in the vacuum enclosure for supporting the delay line, the ring ribbon conductor being formed of a more highly thermally stressed tungsten part and a less thermally stressed molybdenum part.

In accordance with another feature of the invention, there is provided a copper plating disposed on the highly thermally stressed part.

In accordance with a further feature of the invention, 80 to 90% of the length of the ring ribbon conductor of the output section is formed of molybdenum and 10 to 20% is formed of tungsten or copper-plated tungsten.

In accordance with a concomitant feature of the invention, there is provided a solder or welded connection joining the parts of the ring ribbon conductor together.

As mentioned above, 80 to 90% of the conductor length of the output section is formed of molybdenum. The conductor is either eroded from an Mo-tube, or a pre-eroded Mo-sheet is rolled and soldered.

As further discussed above, 10 to 20% of the conductor length is formed of tungsten or of copper-plated tungsten and is then joined to the molybdenum conductor by means of a soldering or welding connection. This end of the conductor length is then used on the RF output side, i.e., where a large effort for optimizing the heat removal is necessary due to the high power density. This construction permits the utilization of a combined shrinking-soldering technique, which is very cost-effective. In this process, the Mo-side of the line is shrunk in a special shrinking-soldering gauge or pattern such as is known from DE-AS 28 34 135 and U.S. Pat. No. 4,270,069, mentioned above, while the tungsten or tungsten-copper conductor is soldered-in at the same time.

The use of the tungsten-copper conductor has three advantages: First, excellent electric and themal conductivity due to the thick inner coating. Second, very good dimensional stability in manufacture and storage due to the tungsten core. Soldering-in is possible without an internal soldering arbor. Third, a good solder joint is obtained between the conductor and the beryllium-oxide mounting rods. The production of a solder joint between copper and beryllium-oxide normally is a problem because of the large differences in expansion. In this case, however, the tungsten core acts as an expansion compensator, since the ductile copper is soldered-in between two elements with less expansion.

Other features which are considered as characteristic for the invention are set forth in the appended claims.

Although the invention is illustrated and described herein as embodied in a delay line for high-performance traveling-wave tubes, in the form of a ring ribbon conductor, it is nevertheless not intended to be limited to the details shown, since various modifications and structural changes may be made therein without departing from the spirit of the invention and within the scope and range of equivalents of the claims.

Figure 1:
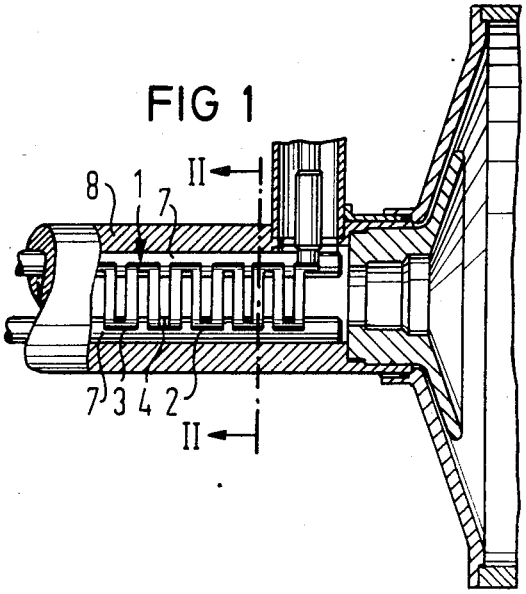

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of a delay line according to the invention; and FIG. 2 is a cross-sectional view taken along the line II—II in FIG. 1, in the direction of the arrows.

Referring now in detail to FIGS. 1 and 2 of the drawing as a whole, in which parts which are not absolutely necessary for an understanding of the invention are not designated in the figures or are omitted, there is seen a delay line for high-performance traveling-wave tubes in the form of a ring ribbon conductor or cable 1 disposed between an electron beam generating system and an electron beam collector within a sturdy or solid copper vacuum enclosure 8. The ring ribbon conductor or delay line 1 is supported by several mounting rods 7 of dielectric material, extending parallel to the delay line or ring ribbon conductor 1. The ring ribbon conductor or delay line 1 is formed of two parts 2, 3. The part 2 is thermally highly stressed and is formed of tungsten and the part 3 is thermally less stressed and is formed of molybdenum. The thernally highly stressed part 2 is preferably formed of copper-plated tungsten. In FIG. 2, the copper layer is provided with reference symbol 5 and the tungsten tube is provided with reference symbol 6. The two parts 2, 3 of the ring ribbon conductor or delay line 1 are joined together by means of a solder or welding connection 4.

The foregoing is a description corresponding in substance to German Application No. P 32 28 529.9, dated July 30, 1982, the International priority of which is being claimed for the instant application, and which is hereby made part of this application. Any material discrepancies between the foregoing specification and the aforementioned corresponding German application are to be resolved in favor of the latter.

I claim:

1. In a traveling-wave tube delay line for high-performance tubes having a massive vacuum-tight copper vacuum enclosure enclosing the delay line, the improvement comprising the delay line being disposed between an electron beam gun assembly and an electron beam collector, a plurality of support rods of a dielectric material extending parallel with the delay line for supporting the delay line, the delay line having two parts, the first part being adjacent the gun assembly end which is highly thermally stressed and consists essentially of tungsten and the second part being spaced away from the first gun assembly end and which is less thermally stressed and consists esentially of molybdenum.

2. A delay line according to claim 1 wherein the first part is formed of copper-plated tungsten.

3. A delay line according to claim 1 in which 80–90% of the length of the delay line is formed of molybdenum and the remainder of the length is formed of tungsten.

4. A delay line according to claim 2 wherein 80–90% of the length of the delay line is formed of molybdenum nd the remainder of the length of the delay line is formed of copper-plated tungsten.

5. Delay line according to claim 1 wherein said first and second parts are joined together by a solder connection.

6. Delay line according to claim 1 wherein said first and second components are formed together by a welded connection.

* * * * *